United States Patent [19]

Vanlauwe

[11] Patent Number: 4,794,684

[45] Date of Patent: Jan. 3, 1989

[54] METHOD OF AND APPARATUS FOR CUTTING TUBES

[75] Inventor: Pierre Vanlauwe, Sens, France

[73] Assignee: Lhomme, SA, Pont sur Yonne, France

[21] Appl. No.: 781,899

[22] Filed: Sep. 30, 1985

[30] Foreign Application Priority Data

Oct. 2, 1984 [FR] France ..... 84 15107

[51] Int. Cl.[4] ..... B24B 5/04; B26D 1/14

[52] U.S. Cl. ..... 29/33 T; 51/5 B; 51/290

[58] Field of Search ..... 29/33 T, 33.5, 33.52, 29/28, 156.62; 51/2 C, 3, 5 R, 5 B, 5 D, 290, 326; 83/863, 174

[56] References Cited

U.S. PATENT DOCUMENTS

| | | | |
|---|---|---|---|
| 1,618,541 | 2/1927 | Long . | |
| 2,600,548 | 6/1952 | Lalime | 51/5 D |
| 3,355,749 | 12/1967 | Steffen | 51/5 B X |
| 3,711,996 | 1/1973 | Braden et al. | 29/156.62 X |
| 3,752,024 | 8/1973 | Judelshon . | |
| 3,822,516 | 7/1974 | Huber | 51/5 B X |
| 3,918,216 | 11/1975 | Best et al. | 51/290 X |
| 4,052,822 | 10/1977 | Obear . | |
| 4,090,424 | 5/1978 | Hall . | |
| 4,467,508 | 8/1984 | Fjallstrom | 29/33 T |

FOREIGN PATENT DOCUMENTS

| | | |
|---|---|---|
| 0013832 | 8/1980 | European Pat. Off. . |
| 2377264 | 8/1978 | France . |
| 0259162 | 10/1926 | United Kingdom . |
| 2122941 | 1/1984 | United Kingdom . |

*Primary Examiner*—Z. R. Bilinsky

*Attorney, Agent, or Firm*—Sandler & Greenblum

[57] ABSTRACT

A method and apparatus for cutting a tube, preferably provided with a hard surface, into pieces which involves first subjecting the coated tube to the grinding action of a disk to remove a narrow band of coating and to effect a shallow groove in the tube prior to contacting the bottom of the groove with a cutting knife to slice the tube into pieces having ends which are essentially planar and perpendicular to the longitudinal axis of the pieces. The knife and grinding disc may be mounted on reciprocally movable carriages. The movable carriage supporting the grinding disc is preferably mounted on an adjustment rod so as to permit precise spacing relative to the exterior surface of the tube. The grinding disc is controlled to prevent it from contacting a mandrel supporting the tube.

8 Claims, 2 Drawing Sheets

F1
F2

METHOD OF AND APPARATUS FOR CUTTING TUBES

BACKGROUND OF THE INVENTION

1. Field of the Invention

The present invention relates to a device for cutting cylindrical tubes into tubes pieces. The cutting device of the present invention is particularly suitable for cutting predetermined lengths of tube pieces from a continuously formed spiral tube made from strips of cellulosic material, such as cardboard or paper, which has been provided with a coating of substance which forms a hard surface on at least a portion of the exterior of the tube.

2. Discussion of Background and Material Information

Cylindrical tubes may be formed from various materials such as cellulosic strips, and treated in different ways depending on their intended use. For example, cardboard tubes may be provided with a hard surface coating which is substantially uniform across their entire surface or only on a portion thereof as required by the situation.

It is conventional to form tubes in a continuous fashion on machines known as spiralers by helically winding a plurality of cellulosic strips, such as paper or cardboard, around a mandrel. The resultant cylinder in its rotation is continuously advanced in a longitudinal direction towards cutting and polishing stations located downstream from the forming station. As the continuously formed tube reaches the cutting station, conventional severing devices are brought into play to slice or cut individual units of desired size from the tube, which may be further subdivided into appropriate sized pieces as desired.

The apparatus used by the prior art to sever continuously formed tubes into pieces or to sever the said pieces, generally has at least one knife which cooperate with a special part of the mandrel supporting the tube or with a special mandrel so as to act against the tube to be cut witch is placed into rotation. In those instances where the cylinder to be cut is provided with a hard surface on at least a portion of its exterior during its formation, or after an initial cutting into tubular pieces, the cutting action of the knives of prior art apparatus often causes a disruption in the hard surface coating which may result in a peeling or scaling of the coating from the surface. It then becomes necessary to perform a subsequent finishing operation which may involve additional polishing in an attempt to repair the damaged surface.

The present invention is directed to a method and apparatus for cutting a coated cylinder into tubular pieces which minimizes peeling or scaling of the coated surface, and hence eliminates the necessity of an additional finishing operation. According to the present invention, an apparatus is provided whereby the coated surface of the tube is subjected to an operation which simultaneously grinds off the surface coating in a narrow band around the area of the tube to be cut while buffing the same so as to prevent feathering, rough edges, and the tendency of the coating to scale or peel. To this end, the apparatus of the present invention is equipped not only with at least one knife for cutting the tube and an apparatus to rotate the tube as it is being formed, but also with a unique arrangement including a grindstone or polishing wheel designed to move transversely towards and away from the tube to a controlled degree so as to precisely score a peripheral groove in the coated surface of the tube around the area where the tube is to but cut with a cutting knife being positioned to finish the cut beginning at the bottom of the furrow or groove formed by the polishing wheel. Although the grindstone or polishing wheel and the knife are programmed to act successively in the foregoing manner, the cutting action of the knife begins almost immediately upon removal of the surface coating and the scoring of the groove caused by the grindstone. The unique arrangement of elements of the apparatus of the present invention also permits the tube to be polished while it is being cut as well as immediately afterward to result with two pieces having smooth, cut end surfaces.

U.S. Pat. No. 3,711,996, BRADEN et al., discloses an apparatus which includes a mill wherein a plurality of rotating grinding wheels are passed by the peripheral surface of a mandrel on which a cylindrical cured cord reinforced rubber sleeve is supported in a direction perpendicular to the longitudinal axis of the mandrel so as to engage a sleeve to cut peripheral grooves in the sleeves while a plurality of rotating cutting blades pass the peripheral surface of the mandrel in a similar manner to sever the sleeve into a plurality of V-belts. Accordingly, the grinding wheels cause the initial openings of the V-shaped grooves through a substantial portion of the thickness of the sleeve while the knives, positioned in pairs, are designed to cut the straps by penetrating into the groove to sever through the relatively thin amount of rubber sleeve which remains. Thus, the goal of this prior art device is to first shape a groove in a relatively soft elastomeric material which is then severed into individual bands so as to result with belts which have been beveled to have a V-shaped configuration.

In contrast, the present invention is directed to solving a completely different problem of reducing or eliminating peeling or scaling of a relatively hard coating from a cylinder whose end surfaces after cutting into tubular pieces must be essentially planar and as perpendicular to the longitudinal axis of the tube as possible.

SUMMARY OF THE INVENTION

The present invention is directed to an apparatus for cutting a cylinder supported on a mandrel having a longitudinal axis into tubular pieces which includes means for abrading positioned laterally with respect to the cylinder and located in a plane perpendicular to the longitudinal axis of the cylinder, the means for abrading being adapted to move transversely with respect to the longitudinal axis of the cylinder so as to make contact with the cylinder to form a groove having a bottom in the cylinder; means for cutting located in the plane perpendicular to the longitudinal axis of the cylinder and positioned laterally with respect to the cylinder, the means for cutting being adapted to move transversely with respect to the longitudinal axis of the cylinder to contact the bottom of the groove and to slice the cylinder into pieces, wherein the means for abrading includes a disc preferably provided with a beveled circumferential edge having a V-shaped such as a grindstone, and the means for cutting is a knife fixed in rotation.

The apparatus in accordance with the present invention, as described above, is preferably provided with a means for reshaping the beveled edge of the grinding wheel positioned laterally with respect to the grinding wheel and adapted to move diagonally with respect to the plane perpendicular to the longitudinal axis of the cylinder so as to contact the beveled edge of the grinding wheel.

The present invention is also directed to an apparatus, as described above, wherein a knife and a grindstone are positioned laterally on the same side of the cylinder, preferably with the knife being positioned below the grindstone, and preferably further including a jack journalled at one end of the framework and at another end to an arm with the arm being pivotally mounted on a support connected to the framework and having an end adapted to mount the knife, and a jack journalled at one end to the framework and at another end to an arm which is pivotally mounted on a support and having an end adapted to rotatably mount the grindstone.

In particular, the present invention is directed to an apparatus for cutting a cylinder into tubular pieces, as described above, which also includes at least one carriage mounted for movement along a means for guiding located in a plane transverse to the longitudinal axis of the cylinder and connected to the framework; a support for the grindstone mounted on a carriage; and a support for a knife mounted on a carriage, preferably including means for imparting movement operably connected to the at least one carriage and wherein the framework includes abutments for stopping the movement and means for reversing movement of the at least one carriage in communication with the means for imparting movement, the means for reversing movement being positioned so that the carriage contacts an abutment and a means for reversing movement at essentially the same time.

The present invention is also directed to an apparatus, as described above, which includes a first carriage to which a support for the grindstone is mounted and a second carriage to which the knife is mounted with the grindstone being positioned diametrically opposite the knife, and preferably wherein a means for adjusting the position of the support for the grindstone is moveably mounted to the first carriage.

The present invention is also directed to a method for cutting a cylinder into pieces which involves positioning an elongate element having a cylindrical surface on a mandrel; contacting the elongate element with a means for abrading to effect a groove around its cylindrical surface; introducing a means for cutting into the grooves to begin slicing the elongate element at the bottom at the groove; and continuing the slicing of the elongate element until it is divided into pieces, wherein the surface of the cylinder has the thickness and the groove has a depth a fraction of less than about 1/5, and preferably about 1/10 of the thickness of the surface of the cylinder.

The present invention is directed to a method as described above, which involves controlling the contact of the means for abrading with the elongate element so as to prevent the means for abrading from making contact with the mandrel.

The present invention is also a method, as described above, wherein the means for abrading has the shape of a disc and further involves rotating the elongate element in a direction around axis of 7 the mandrel and rotating the disc in the same direction.

The present invention is further directed to a method, as described above wherein resultant pieces have ends with surfaces which are essentially plane and perpendicular to the longitudinal axis of the pieces.

The present invention is also directed to a method, as described above, which further involves providing a coating on the surface of the elongate element, which is preferably permitted to harden.

BRIEF DESCRIPTION OF THE DRAWINGS

The invention will be understood clearly upon reading the description which follows of the two embodiments according to the invention which are shown for illustration for purposes only in the annexed drawings in which.

DETAILED DESCRIPTION OF PREFERRED EMBODIMENTS

Figures 1, 2, 3:
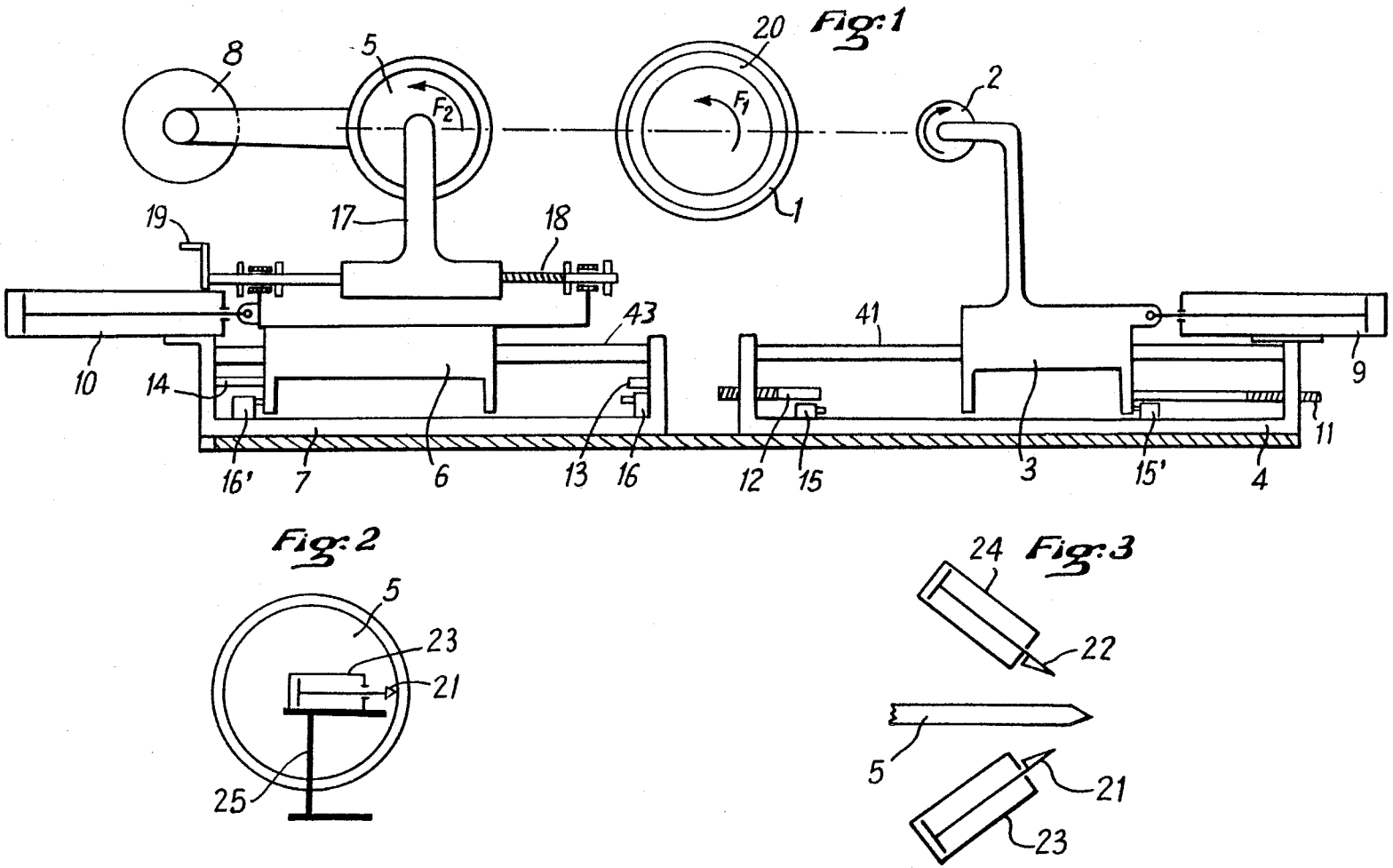
FIG. 1 represents schematically an elevational view of the apparatus according to a first embodiment.
FIGS. 2 and 3 show schematically and respectively in elevation and in partial view from the top, a mill according to the present invention equipped with a means for sharpening or shaping the grindstone or polishing wheel of the mill.

According to one embodiment of the present invention, the mill and the knife are each mounted in position on a different carriage positioned on either side of a vertical plane passing through the longitudinal axis of the cylindrical tube to be cut. In this manner, the carriage may be moved in a plane which is essentially perpendicular to the axis of the tube between an initial position and a maximum position of work which may be adjustable depending on the diameter of the tube and the depth of the desired milling and/or cutting or the reduced diameter of the knife or polishing wheel resulting from the wear and tear of normal use. It is preferable to position the knife on its carriage diametrically opposite to the grinding wheel in their respective relationships to the tube. If this is the case, the grindstone or polishing wheel is positioned on a moveable carriage by means for support which is itself adjustably positioned on the carriage depending upon the previously mentioned conditions. Accordingly, the position of the grinding wheel on the support may be periodically adjusted to ensure that a relatively constant impression is made in the surface of the tube when the mill is brought into play.

According to another embodiment of the present invention, the knife and polishing wheel may be pivotably mounted so as to be activated by a means for control so that the grindstone and knife act successively by each pivoting between two extreme positions with the maximum position of work being predetermined based upon the diameter of the tube and the desired depth of grinding taking into consideration the extent to which the diameter of the polishing wheel has been reduced as a result of normal wear. In this case, the knife and the grindstone are positioned, preferably with the former underneath the latter, on the same side with respect to a vertical plane through the longitudinal axis of the continuously formed cylinder.

In accordance with the present invention, the main purpose of the grindstone is to prepare the surface of the tube, for example by scoring a groove, for subsequent cutting. The grindstone or polishing wheel itself is not intended to do the actual shaping or cutting the cylinder into pieces. Accordingly, the grindstone is preferably disk-shaped having a wedge-shaped circumferential edge when it is placed in rotation in the same direction as the tube although different shapes or profiles of the grooves are possible so long as sharp ridges are avoided.

In this regard, the present invention also provides for a means for shaping, sharpening or otherwise rejuvenating the initial profile of the grindstone or polishing wheel. Although this is usually done when the grindstone is not in use, the present invention also provides for means whereby the grindstone can be subjected to such action while in operation. When the apparatus of the present invention is provided with means to adjust the position of the carriage which transports the grindstone in one embodiment, or by adjusting the means for pivoting the grinding wheel in the second embodiment, the apparatus may be provided with means for sharpening the peripheral edge of the grindstone and knives as they are returned to their extreme position away from the tube. The means for sharpening are brought into play by activating means which are positioned in a fixed manner laterally with respect to the tools when the tools are brought into their extreme position away from the tube. Related to this, if the circumferential edge of grindstone 5 is wedge-shaped, the sides of the wedge can be shaped to be slightly concave in such a manner that the resultant groove in the surface of the tube would be slightly convex having ridges which are slightly rounded.

In the situation where the apparatus of the present invention is positioned at the end of a spiraler, it is necessary for the means for cutting to follow the progression of the tube as it is formed in a continuous manner. Accordingly, the grindstone and the knife can be adapted to move longitudinally along with the advancement of the tube, as well as to be returned to its initial position. In addition, the apparatus of the present invention has utility for cutting single, rather than continuously formed, cylindrical tubes.

Turning now to the drawings, FIG. 1 shows a cylindrical tube 1 formed from cellulosic materials, such as cardboard or paper strips, positioned on a mandrel 20 or other means for supporting the tube. A knife 2 as a means for cutting is mounted on carriage 3 which is operably associated with framework 4 positioned at one side of the cylindrical tube. A disc-shaped grindstone or polishing wheel 5 as a means for milling is also mounted on a movable carriage 6 which is operably associated with framework 7. As shown in FIG. 1, tube 1 is rotated in the direction of arrow F1 shown to be counterclockwise, with means for grinding 5 being rotated in the same direction as shown by arrow F2. In the illustrated embodiment, the disk is rotated by means of a belt mounted around a shaft connected to a pulley motor 8 although other conventional drive mechanisms could be suitably used for purposes of rotating the disk. Carriage 3 for transporting knife 2 and carriage 6 for transporting the grindstone or polishing wheel 5 are positioned on either side of cylindrical tube 1 in such a manner that the knife and the grindstone are diametrically opposed to each other with respect to tube 1. In operation, the carriages 3 and 6 are activated to transport, respectively, knife 2 and grindstone 5 transversely with respect to the longitudinal axis of the tube towards and away from the tube by means of jacks 9 and 10, respectively, which may be mechanically, pneumatically, or hydraulically operated. Carriages 3 and 6 are mounted on rods 41 and 43, respectively, as means for guiding the carriage so as to ensure their precise course of action. Attached to frameworks 4 and 7 are abutments 11, 12, 13, and 14 which define the length of transverse movement of carriages 3 and 6 within their respective frameworks. Although abutments 13 and 14 are shown for purposes of example as being fixedly mounted to the framework, the abutments are preferably adjustably mounted to their framework in the manner shown for abutments 11 and 12. Accordingly, the path of the carriages may be shortened or lengthened to accommodate different sized tubes, knives and grindstone by adjusting the position of the abutments. In this regard, abutments 11 and 12 are shown, for example, as being threadedly engaged through tapped openings in framework 4.

The grindstone or polishing wheel 5 has a circumferential edge which is shown more clearly in FIG. 3 as being wedge-shaped. The grindstone 5 is mounted for rotation on a support which in turn is operably associated with carriage 6 by means of a micrometer screw-type adjustment rod 18. The support 17 is moved transversely towards and away from tube 1 by turning a wheel equipped with a handle or crank 19 which is attached to an end of adjustment rod 18, although any conventional power source can be used for this purpose.

In FIG. 1, carriages 3 and 6 are shown in their extreme distant positions with respect to tube 1. In order to effect the cutting of the tube, jack 10 is activated to cause carriage 6 on which grindstone 5 is supported towards tube 1. Upon contact of the disk with the tube, the grindstone begins abrading the surface and penetrates the tube to a predetermined depth, for example less than 20% and preferably about 10% of the thickness of the tube. The depth to which the disk penetrates the tube is controlled by the distance carriage 6 moves along guide rod 43 which is ultimately determined by the length or position of abutment 13 and microcontacts 16 which are mounted in framework 7 in such a way that advancement of the grindstone 5 is not permitted to proceed to such an extent that the grindstone would abrade completely through the tube and come into contact with mandrel 20. Framework 4 is similarly provided with microcontacts 15 and 15'. Whereas abutments 11, 12, 13, and 14 act as physical stops to the movement of the carriages, microcontacts 15, 15', 16, and 16' are electronically connected to a power source for jacks 9 and 10 to activate their movement. For example, when carriage 6 stops against abutment 13, carriage 6 also makes contact with microcontact 16 which sends a signal to the drive mechanism for jack 10 to cause it to reverse its direction and retract carriage 6 to a readiment position away from tube 1. The abutments and microcontacts mounted to framework 4 operate in a similar fashion with respect to the movement of knife 2 supported on carriage 3.

The knife is brought into play once disk 5 has scored a groove around tube 1 by penetrating first into the groove left by the disk and then into the tube itself until carriage 3 comes into contact with abutment 12 and microcontact 15 to stop its forward movement. The activation of microcontact 15 then causes a reversal of the movement of jack 9 so as to retract carriage 3 away from tube 1 until the carriage comes into contact with abutment 11 and microcontact 15' whereat the elements are once again in their initial readiment position, as shown in FIG. 1, in anticipation of another cutting cycle.

FIGS. 2 and 3 show means for sharpening or rectification of the grindstone or polishing wheel which are preferably diamonds 21 and 22 reciprocally moveable towards and away from grindstone 5 by the action of jacks 23 and 24. The jacks 23 and 24 are mounted on supports 25 positioned on either side of grindstone 5 and may be attached to framework 7. This particular arrangement permits grindstone 5 to be sharpened or reshaped periodically when carriage 6 is retracted to its extreme distant position away from tube 1.

The arrangement of support 17, to which grindstone 5 is mounted, on adjustment rod 18 allows for the distance of the support relative to the exterior surface of the tube to be adjusted so as to accommodate the change in diameter of the grindstone as a result of being sharpened or reshaped. In this manner, the circumferential edge of the grindstone still occupies the same relative position with respect to the work plane, i.e., the exterior surface of the tube to be cut, despite the decrease in the diameter of the grindstone. Accordingly, abutments 13 and 14 do not have to adjusted as a result of this operation, and may be fixed as shown, rather than being adjustably mounted, in position on framework 7. Although the adjustments to the position of support 17 and the shaping of the circumferential edge of grindstone 5 may be carried out manually, these elements can be connected to electronic equipment which can be programmed to perform these functions automatically.

Although the relative position of the circumferential edge of the grindstone with respect to the exterior surface of the tube is maintained essentially constant by the manipulation of adjustment rod 18 to accommodate for a loss in diameter of the disk, this result could also be achieved by adjusting abutments 13 and 14, if necessary.

Figure 4:
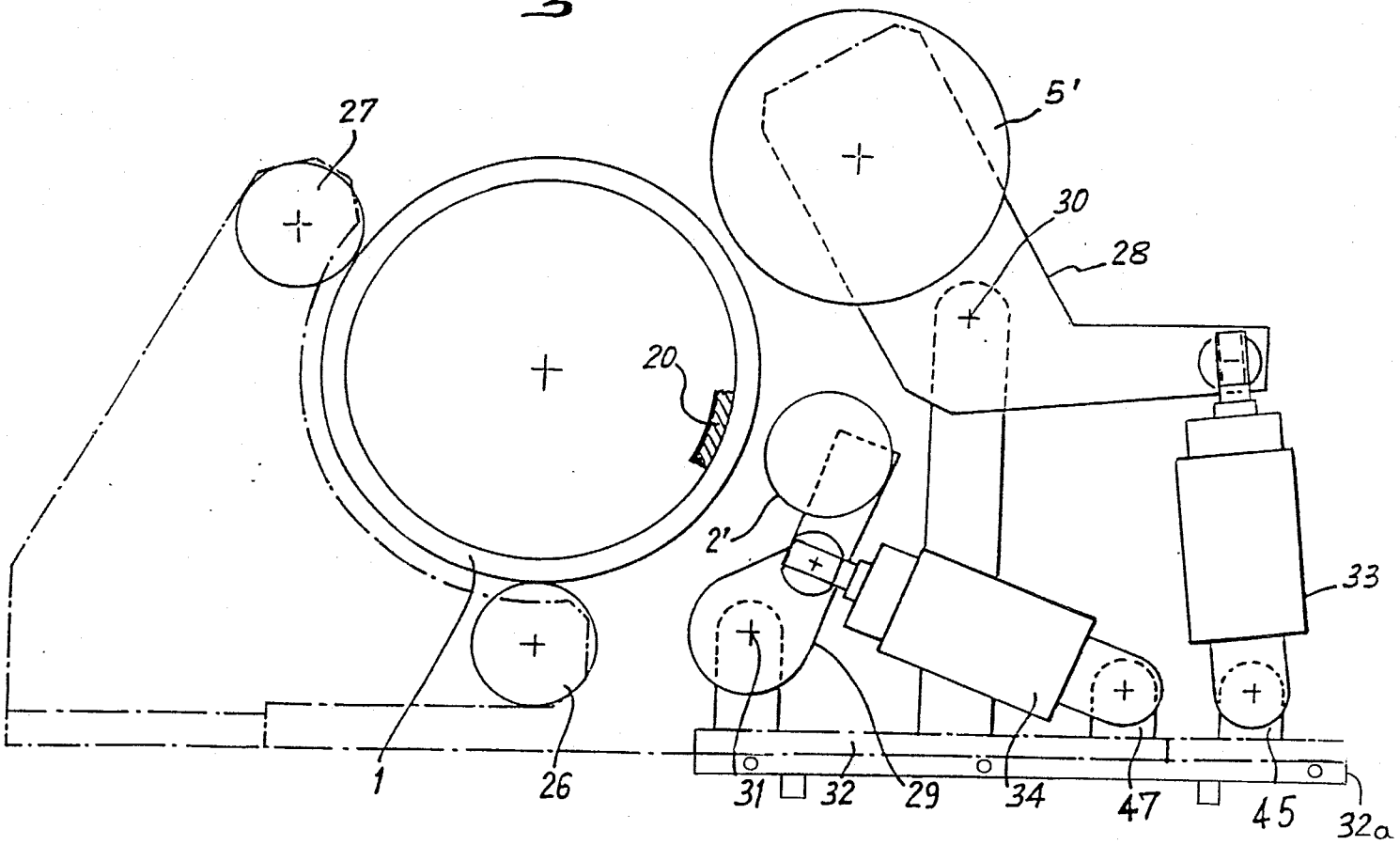
FIG. 4 shows another embodiment according to the invention wherein the knife and mill are positioned in a pivoting manner.

FIG. 4 shows another preferred embodiment according to the present invention. As in the other embodiments, tube 1 is supported by mandrel 20. As shown, two rollers 26 and 27 are provided to guide and rotate tube 1 in its longitudinal movement from the forming station towards the cutting station. In this embodiment, however, grindstone 5' and knife 2' are mounted on arms 28 and 29, respectively, which are pivotally connected to stanchions 30 and 31 mounted to framework 32. The arms 28 and 29 are connected to an end of jacks 33 and 34, respectively, the opposite ends of which are pivotally connected to mountings 45 and 47 which are attached to framework 32.

Referring again to FIG. 4, knife 2' in preference fixed in rotation is positioned under grindstone 5' on the same side with respect to a vertical plane passing through the longitudinal axis of tube 1 although other suitable arrangements could also be used without departing from the spirit and scope of the present invention. It is also possible to provide this particular arrangement of the knife with respect to the grindstone so as to have a means for sharpening or shaping the circumferential edge of the grindstone in a manner similar to that which has been previously described with respect to the first embodiment. One could also use a grindstone or polishing wheel impregnated with diamond powder for either of the embodiments discussed herein.

In operation, jacks 33 and 34 are controlled so that grindstone 5' is activated first by jack 33 which then retracts while jack 34 activates knife 2' before retracting itself in turn to return to the initial position wherein grindstone 5' and knife 2' are spaced away from tube 1.

Although the extreme initial and final positions of arms 28 and 29 are predetermined, there are several means for controlling the positioning of these elements to ensure that the grindstone don's make contact with mandrel 20 during grinding or polishing similar to those previously described herein. In contract the knife 2' (or 2 FIG. 1) can take contact with mandrel 20 this latter being a special mandrel (for continuously formed tube) or being provided with a special port (for individual units of tube), disposed in front of the asaid knife and forming a counterknife which is into rotation with the said tube. Again, the diameter of the tube, the depth of the desired scoring, and the diameter of the particular element, taking into consideration its wear and tear, are factors which enter into making the necessary adjustments to ensure the precise operation of the apparatus.

In applications where it is desired to move knife 2, 2' and disk 5 and 5', longitudinally with the movement of tube 1, frameworks 4, 7, and 32 with which these elements are associated, may in turn be mounted on a means for transporting **32*a* the respective assemblies in a longitudinal direction parallel to the longitudinal axis of tube 1. Accordingly, framework 4, and 7 and 32 may be mounted to the carriage which is adapted to move reciprocally back and forth for a predetermined distance along the path of tube 1**.

The depth of the score or groove to be effected by grindstone 5 will depend primarily upon the hardness of the surface coating as well as the thickness of the coating. In general, however, the thickness of the coating is minimal with respect to the thickness of the tube itself. Consequently, the cutting action of the knife is significantly greater than the action of the grindstone which penetrates into the surface of the tube to a relatively insignificant degree, i.e., a maximum of about 20% of its thickness.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An apparatus for cutting a cylinder positioned on a mandrel having a longitudinal axis into tubular pieces, comprising:

(a) a framework including a platform for supporting said apparatus located to one side of said mandrel;

(b) a jack journalled at one end to said platform and at another end to an arm, said arm being pivotally mounted on a support connected to said platform and having an end to which a grindstone is rotatably mounted, said grindstone being adapted to move transversely with respect to said longitudinal axis for making contact with said cylinder to form a groove having a bottom in said cylinder; and (c) another jack journalled at one end to said platform and at another end to a second arm pivotally mounted on a second support connected to said platform and having an end to which knife is mounted, said knife being adapted to move transversely with respect to said longitudinal axis to contact said bottom of the groove and to slice said cylinder into pieces having ends which are essentially planar and perpendicular to said longitudinal axis wherein said grindstone and knife are positioned laterally on the same side with respect to said cylinder.

2. An apparatus in accordance with claim 1, wherein said grindstone is in the form of a disc.

3. An apparatus in accordance with claim 2 wherein said disc is provided with a beveled circumferential edge.

4. An apparatus in accordance with claim 3 wherein said edge is beveled into a V-shape.

5. An apparatus in accordance with claim 4 wherein said grindstone is connected to a means for powering said grindstone.

6. An apparatus in accordance with claim 5 further comprising means for reshaping said beveled edge positioned laterally with respect to said grindstone and adapted to move diagonally with respect to said plane to contact said edge.

7. An apparatus in accordance with claim 1, wherein said knife is positioned below said grindstone.

8. An apparatus for cutting a cylinder positioned on a mandrel having a longitudinal axis into tubular pieces, in accordance with claim 1, further comprising:

(d) means for moving said platform longitudinally with respect to said longitudinal axis connected to said framework.

* * * * *

UNITED STATES PATENT AND TRADEMARK OFFICE

CERTIFICATE OF CORRECTION

PATENT NO. : 4,794,684

DATED : Jan. 3, 1989

INVENTOR(S) : Pierre VANLAUWE

It is certified that error appears in the above-identified patent and that said Letters Patent is hereby corrected as shown below:

At column 1, line 8, change "tubes" to —tube— (2nd Occurrence) after "into".

At column 2, line 4, change "but" to —be—. At column 3, line 63, delete "7" after "of".

At column 5, line 45, change "milling" to —grinding or polishing—.

At column 7, line 68, change "don's" to —doesn't—.

At column 8, line 2, change "contract" to —contrast—.

At column 8, line 6, change "asaid" to —said—.

At column 8, line 19, delete "and" before "7".

Signed and Sealed this

Thirteenth Day of August, 1991

*Attest:*

HARRY F. MANBECK, JR.

*Attesting Officer*

*Commissioner of Patents and Trademarks*